United States Patent [19]

Yoshimura

[11] Patent Number: 4,858,284

[45] Date of Patent: Aug. 22, 1989

[54] SEPARABLE BOTTOM END STOP FOR SLIDE FASTENER

[75] Inventor: Eiichi Yoshimura, Mattersburg, Austria

[73] Assignee: Yoshida Kogyo K. K., Tokyo, Japan

[21] Appl. No.: 182,174

[22] Filed: Apr. 15, 1988

[30] Foreign Application Priority Data

Apr. 20, 1987 [JP] Japan ..... 62-59363[U]

[51] Int. Cl.[4] ..... A44B 19/36

[52] U.S. Cl. ..... 24/433; 24/436

[58] Field of Search ..... 24/433–436, 24/388

[56] References Cited

U.S. PATENT DOCUMENTS

| | | | |
|---|---|---|---|
| 2,358,178 | 9/1944 | Marinsky et al. | 24/433 |
| 2,701,401 | 2/1955 | Dorman | 24/433 |
| 2,887,749 | 10/1959 | Morin . | |
| 2,894,305 | 7/1959 | Brown | 24/436 |
| 3,964,136 | 6/1976 | Panzeri | 24/433 |
| 4,270,248 | 6/1981 | Akashi | 24/433 X |
| 4,441,235 | 4/1984 | Kusayama . | |

FOREIGN PATENT DOCUMENTS

| | | |
|---|---|---|
| 0122427 | 10/1984 | European Pat. Off. . |
| 0187302 | 7/1986 | European Pat. Off. . |
| 2341351 | 3/1975 | Fed. Rep. of Germany . |
| 2288492 | 5/1976 | Japan . |
| 59-37064 | 10/1984 | Japan . |

*Primary Examiner*—James R. Brittain

*Attorney, Agent, or Firm*—Hill, Van Santen, Steadman & Simpson

[57] ABSTRACT

A separable bottom end stop includes first and second end stop members mounted on respective stringer tapes of a slide fastener at lowermost ends of the rows of coupling elements. The first end stop member has a first finger on an end thereof and a tooth remote from the first finger, and the second end stop member has a second finger on an end thereof for interfitting engagement with the first finger and an elastic wall remote from the second finger and positioned for being elastically deformable by pressed engagement with the tooth. The first and second end stop members having a combined width normally greater than the smallest distance between flanges of a slider to be mounted on the rows of coupling elements. When the elastic wall is elastically deformed by pressed engagement with the tooth at the time the end stop members are forcibly passed through the slider between the flanges, the combined width is reduced to an extent smaller than the smallest distance between the slider flanges.

5 Claims, 5 Drawing Sheets

SEPARABLE BOTTOM END STOP FOR SLIDE FASTENER

BACKGROUND OF THE INVENTION

1. Field of the Invention:

The present invention relates to a separable bottom end stop for preventing a slider from running off intermeshing rows of coupling elements of a slide fastener, and more particularly to a separable bottom end stop that can be united by a slider.

2. Description of the Prior Art:

FIG. 5 of the accompanying drawings illustrates a conventional separable bottom end stop disclosed in Japanese Patent Publication No. 59-37064. This known separable bottom end stop comprises a uniting element A and a uniting end element B which are located at a lowermost end of a row of coupling elements mounted on one of two stringer tapes and a slider stopping element C disposed at a lowermost end of a companion rod of coupling elements mounted on the other stringer tape. When the bottom end stop is to be passed through a slider (not shown) to install the slider on the coupling elements, the slider stopping element C is inclined with respect to the longitudinal axis of the row of coupling elements. After the slider stopping element C has passed through the slider between its diamond and an outer flange, the slider stopping element C is moved back to its original position into engagement with the uniting element A and the uniting end element B to complete the bottom end stop.

Another known separable bottom end stop which is disclosed in West German Laid-Open Patent Publication No. 2341351 is illustrated in FIG. 6 of the accompanying drawings. The separable bottom end stop comprises a pair of end stop members including respective elastically deformable fins D on their outer sides. When the bottom end stop is moved through a slider (not shown) to mount the slider on a pair of rows of coupling elements, the fins D are elastically deformed inwardly, i.e., toward each other. After the bottom end stop has passed through the slider, the fins C are displaced back to their outer positions, i.e., away from each other thereby to stop downward movement of the slider past the bottom end stop.

With the former known bottom end stop, however, the elements A, B, C thereof cannot easily be positioned relatively to each other. Since the slider stopping element C has to be inclined for the passage through the slider, it is difficult to insert the bottom end stop automatically through the slider. Moreover, the elements of the bottom end stop cannot be extrusion-molded simultaneously with the coupling elements. According to the latter known bottom end stop, the bottom end stop members can be extrusion-molded at the same time that the coupling elements are molded. Since, however, the fins project outwardly, they tend to be damaged by collision with the slider. Therefore, the bottom end stop does not have a required degree of durability. The bottom end stop has a poor appearance because of the presence of the outwardly projecting fins.

SUMMARY OF THE INVENTION

It is an object of the present invention to provide a bottom end stop for a slide fastener, which can be extrusion-molded simultaneously with coupling elements of the slide fastener, can be inserted automatically through a slider, is highly durable, and has a good appearance.

According to the present invention, there is provided a separable bottom end stop on a slide fastener including a pair of rows of coupling elements mounted respectively on a pair of stringer tapes, the separable bottom end stop comprising a first end stop member mounted on one of the stringer tapes at an end of one of the rows of coupling elements, the first end stop member having a first finger on an end thereof and a tooth remote from the first finger, and a second end stop member mounted on the other stringer tape at an end of the other row of coupling elements, the second end stop member having a second finger on an end thereof for interfitting engagement with the first finger and an elastic wall remote from the second finger and positioned for being elastically deformable by pressed engagement with the tooth, the first and second end stop members having a combined width normally greater than the smallest distance between flanges of a slider to be mounted on the rows of coupling elements, the combined width being reduceable to an extent smaller than the smallest distance when the elastic wall is elastically deformed by pressed engagement with the tooth.

When the end stop members are forced to pass through the slider between the flanges, the elastic wall is elastically deformed by the tooth to reduce the combined width to allow the passage of the end stop members through the slider. After the end stop members have passed through the slider, the end stop members are elastically displaced outwardly back to the greater combined width to stop the slider against movement past the end stop members off the rows of coupling elements.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
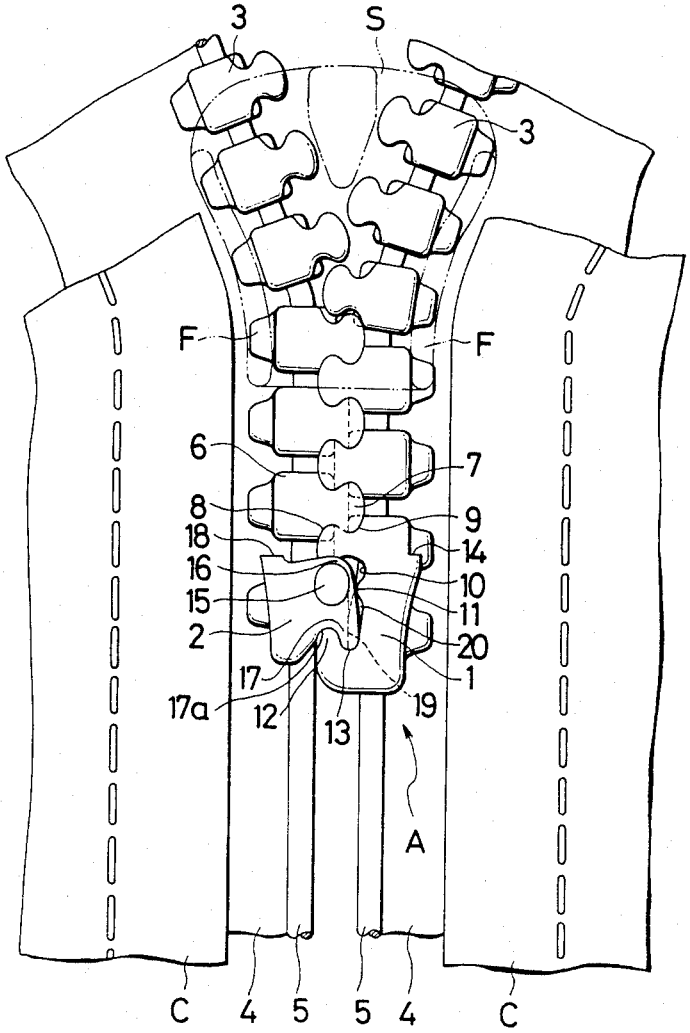
FIG. 1 is a fragmentary plan view of a slide fastener including a separable bottom end stop according to the present invention.

The principles of the present invention are particularly useful when embodied in a separable bottom end stop generally designated by the reference numeral A in FIG. 1.

The bottom end stop A comprises two separable members 1, 2 which are combined with each other in preventing a slider S from running off intermeshing rows of coupling elements 3 mounted respectively on slide fastener tapes 4. The bottom end stop members 1, 2 are extrusionmolded of a thermoplastic resin such as polyacetal on the slide fastener stringer tapes 4 astride of respective longitudinal inner beaded edges 5. The bottom end stop members 1, 2 are molded at the same time that the coupling elements 3 are molded on the stringer tapes 4. The stringer tapes 4 are sewn to suitable fabrics C, respectively, such as of a garment.

As shown in FIG. 1, the end stop member 1, shown on the righthand side, is generally of an inverted C shape and positioned at a lowermost end of one of the rows of coupling elements 3 on the corresponding stringer tape 4. The end stop member 1 has on its upper portion a coupling head 8 and a neck portion 9 which are positioned off the bead 5 for meshing engagement with the coupling head 7 of a lowermost coupling element 6 on the opposite stringer tape 4, which is disposed adjacent to the other end stop member 2. The end stop member 1 thus meshing with the lowermost coupling element 3 gives the bottom end stop A a required degree of mechanical strength for preventing the bottom end stop A from being split open under a lateral pull applied to the slide fastener. The end stop member 1 has an intermediate portion including a recess 10 opening toward the end stop member 2 for receiving therein a confronting portion of the end stop member 2. The intermediate portion of the end stop member 1 also has a tooth or projection 11 disposed slightly upwardly of the center of the recess 10 and projecting toward the end stop member 2. The end stop member 1 also has on its lower portion a finger 12 spaced from the bead 5 and directed toward the coupling head 8. The finger 12 defines, with the intermediate portion of the end stop member 1, a cavity 13 positioned off the bead 5 and opening toward the coupling head 8, the cavity 13 being shaped to snugly receive a finger 17 (described later) of the end stop member 2. When the bottom end stop A passes through the slider S, the finger 17 is inserted downwardly into the cavity 13 to combine and position the end stop members 1, 2 relatively to each other. The end stop member 1 also has a shoulder 14 on an outer side of the upper portion thereof. The shoulder 14 is positioned for engaging the lower end of a flange F of the slider S, once installed on the rows of coupling elements 3, to serve as a stop for preventing the slider S from running off the rows of coupling elements 3, as described in detail later on.

The other end stop member 2, shown on the lefthand side, has a through hole 15 defined slightly above the center of a portion thereof which confronts the end stop member 1, thus providing an elastic wall 16 facing the end stop member 1. The elastic wall 16 is elastically deformable, due to the resiliency of the synthetic resin which the bottom end stop is made of, inwardly into the hole 15 by pressed engagement with the tooth 11. The end stop member 2 has the finger 17 on its lower portion which is directed downwardly and positioned off the bead 5. The finger 17 and the body of the end stop member 2 jointly define therebetween a cavity 17*a* in which the finger 12 of the end stop member 1 can be fitted. The end stop member 2 has a shoulder or stop 18 on an outer upper end thereof for engagement with the lower end of an opposite flange F of the slider S, after it has been installed on the rows of coupling elements 3, for preventing the slider S from running off the coupling elements 3. The hole 15 of the end stop member 2 may be closed off by a pin (not shown) inserted therein or an ultrasonically fused mass after the slider S has been moved over the bottom end stop A onto the rows of coupling element 3, so that the bottom end stop A can have increased mechanical strength.

The end stop member 2 has a longitudinal groove 19 defined in its side surface facing the end stop member 1, and the end stop member 1 has a slanted longitudinal ridge 20 projecting on its side surface facing the end stop member 19, the ridge 20 having a lower portion snugly fittable in the groove 19 when the end stop members 1, 2 are combined with each other. When the lower portion of the ridge 20 is fitted in the groove 19, the end stop members 1, 2 are prevented from being forced apart under a thrusting force applied thereto either on the face or back of the slide fastener.

In a modification, the tooth 11 may be disposed on the end stop member 2, and the elastically deformable wall 16 may be disposed on the end stop member 1. The elastic wall 16 may be provided by a recess cut out from the upper end of the end stop member, rather than by the through hole 15.

Figure 2:
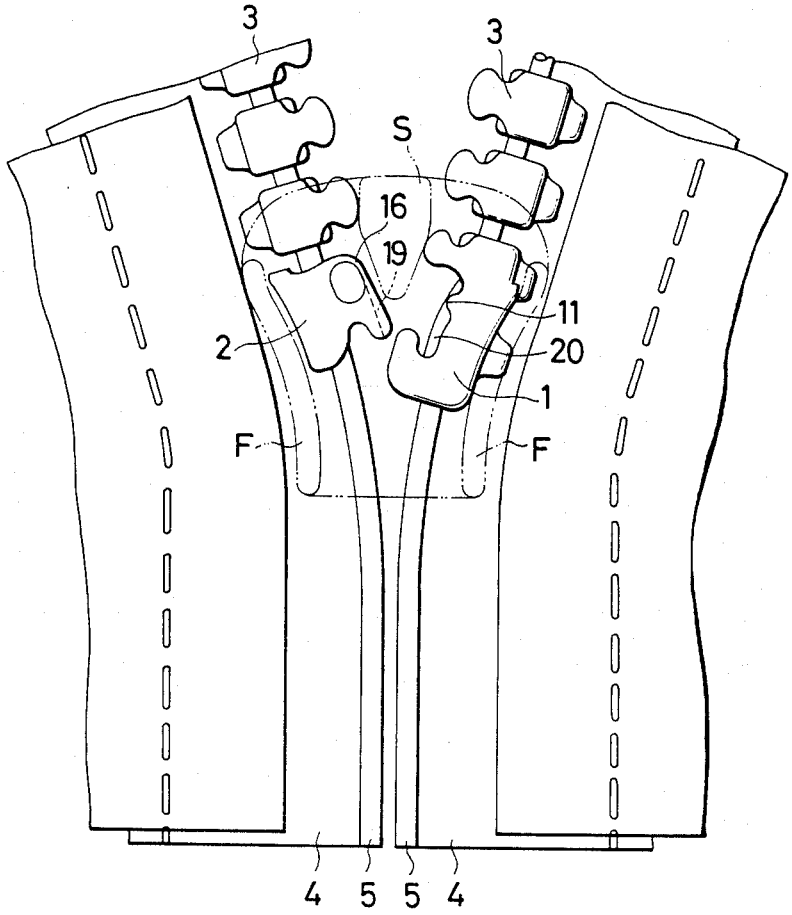
FIGS. 2, 3 and 4 a fragmentary plan views showing a successive sequence of assembling the separable bottom end stop as it passes through a slider.
Figure 3:
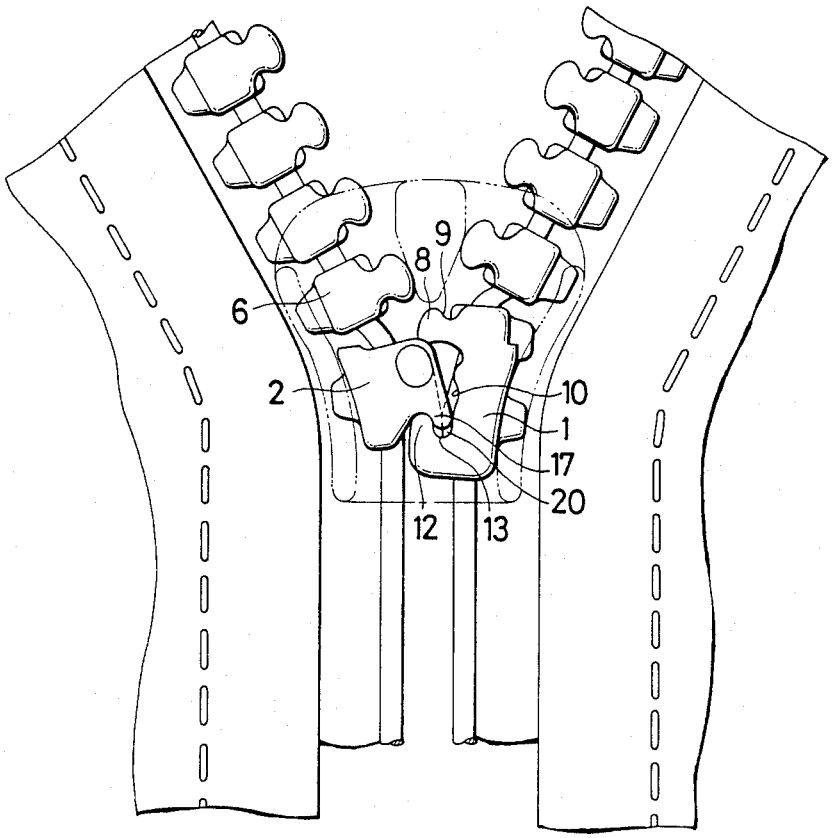
Figure 4:
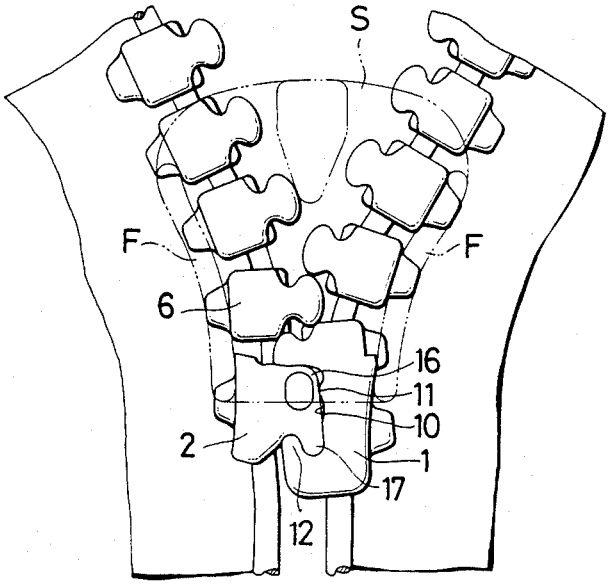
Figure 5:
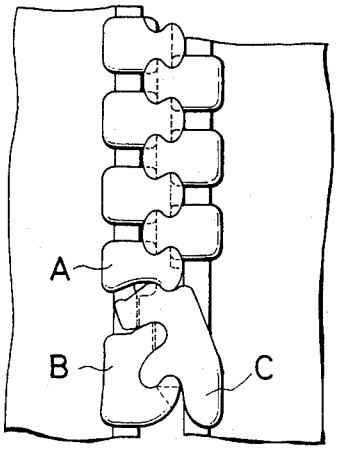
FIG. 5 PRIOR ART
FIGS. 5 and 6 are fragmentary plan views of slide fasteners with conventional separable bottom end stops.
Figure 6:
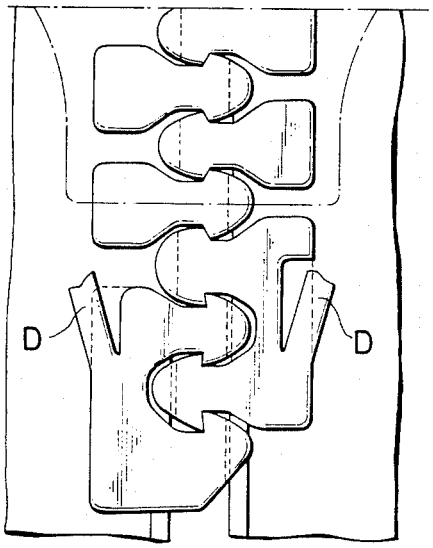
FIG. 6 PRIOR ART

The end stop members 1, 2 are combined or interfitted with each other according to a sequence shown in FIGS. 2 through 4. As shown in FIG. 2, with the slide fastener stringer tapes 4 held closely to each other, the end stop members 1, 2 are inserted into the slider S from its upper separated openings or shoulder slots. As the end stop members 1, 2 enter the slider S, the finger 17 of the end stop member 2 goes into the cavity 13 of the end stop member 1, while at the same time the finger 12 of the end stop member 1 goes into the cavity 17*a* of the end stop member 2, as shown in FIG. 3. Thus, the fingers 12, 17 are interlocked or positioned with respect to each other. Then, the stringer tapes 4 are pulled downwardly to bring the upper portion of the end stop member 2 into the recess 10 of the end stop member 1. At this time, the combined width of the upper portions of the end stop members 1, 2 is larger than the distance between the lower portions of the flanges F of the slider S because of the tooth 11 of the end stop member 1, and the combined width of the lower portions of the end stop members 1, 2 is slightly smaller than the distance between the lower portions of the flanges F of the slider S. A further downward pull on the stringer tapes 4 forces the end stop members 1, 2 progressively into the slider S while at the same time the elastic wall 16 is elastically deformed into the hole 15 by the tooth 11, as shown in FIG. 4. Therefore, the combined width of the upper portions of the end stop members 1, 2 is reduced to the extent that the end stop members 1, 2 can pass through the slider S between the flanges F. After the end stop members 1, 2 have passed through the slider S, the elastic wall 16 springs back to its original undeformed shape, whereupon the upper portions of the end stop members 1, 2 are displaced away from each other. Now, as illustrated in FIG. 1, the coupling head 8 of the end stop member 1 meshes with the coupling head 7 of the lowermost coupling element 6. The end stop members 1, 2 are fully combined with each other. The shoulders or stops 14, 18 of the end stop members 1, 2 are positioned in the respective paths of movement of the flanges F of the slider S for thereby stopping the slider S against downward movement past the bottom end stop A off the intermeshing rows of coupling elements 3.

The end stop members 1, 2 can be extrusion-molded simultaneously with the coupling elements 3. When the end stop members 1, 2 are passed through the slider S, they are neatly positioned relatively to each other by the fingers 12, 17 and automatically elastically deformed and displaced back to permit the slider S to be mounted easily. The end stop members 1, 2 are more durable and sightly than the conventional separable bottom end stop components.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A slide fastener including a pair of stringer tapes, a pair of rows of coupling elements mounted respectively on said stringer tapes along their inner longitudinal edges, a slider slidably mounted on said rows of coupling elements and having opposed flanges, and a separable bottom end stop mounted on said slide fastener at an end thereof, said separable bottom end stop comprising:

a first end stop member mounted on one side of said stringer tapes at an end of a corresponding one of said rows of coupling elements adjacent to an endmost coupling element of said one coupling element row, said first end stop member having a recess opening toward the other stringer tape, a first finger disposed at an end of said first end stop member remote from said endmost coupling element and projecting in an outwardly direction therefrom and in an upwardly direction toward said endmost coupling element and further defining a part of said recess, and a tooth disposed between said endmost coupling element and said first finger and projecting into said recess in said outwardly direction toward said other stringer tape; and a second end stop member mounted on said other stringer tape at an end of the other row of coupling elements, said second end stop member having a portion receivable in said recess in said first end stop member, said portion having a second finger on an end thereof for interfitting engagement with said first finger and an elastic wall remote from said second finger, said elastic wall confronting said tooth and being positioned for being elastically deformable by pressed engagement with said tooth, said elastic wall being a means for said first and second end stop members having a combined width when joined together normally greater than the smallest distance between said opposed flanges of said slider and said combined width being reducible to an extent smaller than said smallest distance when said elastic wall is elastically deformed by pressed engagement with said tooth.

2. A slide fastener according to claim 1, said first and second end stop members having stops, respectively, engageable with ends of said flanges of said slider, said combined width being defined across said stops.

3. A slide fastener including a pair of stringer tapes, a pair of rows of coupling elements mounted respectively on said stringer tapes along their inner longitudinal edges, a slider slidably mounted on said rows of coupling elements and having opposed flanges, and a separable bottom end stop mounted on said slide fastener at an end thereof, said separable bottom end stop comprising:

a first end stop member mounted on one of said stringer tapes at an end of one of said rows of coupling elements, said first end stop member having a first finger on an end thereof and a tooth remote from said first finger; and a second end stop member mounted on the other stringer tape at an end of the other row of coupling elements, said second end stop member having a second finger on an end thereof for interfitting engagement with said first finger and an elastic wall remote from said second finger and positioned for being elastically deformable by pressed engagement with said tooth, said first and second end stop members having a combined width when joined together normally greater than the smallest distance between said opposed flanges of said slider, said combined width being reducible to an extent smaller than said smallest distance when said elastic wall is elastically deformed by pressed engagement with said tooth, said second end stop member further having a through hole, said elastic wall partly defining said through hole.

4. A slide fastener according to claim 3, said first and second end stop members having stops, respectively, engageable with ends of said flanges of said slider, said combined width being defined across said stops.

5. A separable bottom end stop according to claim 3, said first end stop member having a substantially C shape including a recess in which said tooth is disposed, said elastic wall being positionable in said recess.

* * * * *